US006674183B1

(12) United States Patent
Noda et al.

(10) Patent No.: US 6,674,183 B1
(45) Date of Patent: Jan. 6, 2004

(54) ROTARY SWITCH WITH ROTATABLE CONTACT

(75) Inventors: Masuo Noda, Aichi (JP); Kazuyoshi Ishiguro, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 69 days.

(21) Appl. No.: 09/625,955

(22) Filed: Jul. 26, 2000

(30) Foreign Application Priority Data

Jul. 26, 1999 (JP) ..... 11-210611

(51) Int. Cl.[7] ..... H01H 47/00
(52) U.S. Cl. ..... 307/132 E; 200/571
(58) Field of Search ..... 307/9.1, 10.1, 307/139, 132 E; 200/175, 179, 11 R, 11 A, 11 B, 11 C, 11 D, 11 DA, 11 E, 11 G, 11 H, 11 J, 11 K, 11 TL, 11 TW, 564, 565, 566, 567, 568, 569, 570, 571, 572

(56) References Cited

U.S. PATENT DOCUMENTS 4,433,607 A * 2/1984 Kemeny ..... 124/3
4,586,011 A * 4/1986 Mostosi ..... 335/16
4,748,297 A * 5/1988 Sorenson et al. ..... 200/11 J
4,876,416 A * 10/1989 Frantz et al. ..... 200/11 DA
4,945,195 A * 7/1990 Ipcinski ..... 200/11 R
5,161,422 A * 11/1992 Suman et al. ..... 180/315
5,287,005 A * 2/1994 Shinkawa ..... 200/1 V
5,691,612 A * 11/1997 Corey ..... 318/444
6,222,139 B1 * 4/2001 Pandit et al. ..... 200/11 A
6,239,679 B1 * 5/2001 Comtois et al. ..... 335/127
6,246,020 B1 * 6/2001 Sato ..... 200/263
6,262,497 B1 * 7/2001 Muroi et al. ..... 307/116
6,399,905 B1 * 6/2002 Nishikawa et al. ..... 200/61.54

FOREIGN PATENT DOCUMENTS

DE 443 698 C * 5/1997

* cited by examiner

*Primary Examiner*—Brian Sircus
*Assistant Examiner*—Sharon A. Polk
(74) *Attorney, Agent, or Firm*—Morgan, Lewis & Bockius LLP

(57) ABSTRACT

A contact 24 is fitted to an insulator complete 25, and the contact 24 is adapted to rotate in correspondence with the operation of an operation knob. The length of an arm 38 among arm portions 37 to 39 which are provided on the contact 24 is set to be shorter than the other arm portions 37 and 39. As a result, fixed contacts 40*a* and 41*a* with which movable contacts 37*a* and 38*a* provided at distal ends of the arms 37 and 38 are brought into contact can be arranged at concentric positions, thereby making it possible to increase the number of contacts. In this case, since a relay for a small-current load is connected to the fixed contact 41*a*, no hindrance is caused even if the contact force of the second movable contact 38*a* is set to be small by devising the angles between the respective ones of the arm portions 37 to 39.

15 Claims, 14 Drawing Sheets

RELATED ART

RELATED ART

ROTARY SWITCH WITH ROTATABLE CONTACT

BACKGROUND OF THE INVENTION

1. Field of the Invention

The present invention relates to a rotary switch in which particular ones of fixed contacts are made electrically conductive in correspondence with the rotated position of a contact.

2. Description of the Related Art

FIG. 15 shows the structure of a contact of a blower switch of the type in which, for instance, a blower motor for a vehicle (max. 200-Watt level) is directly switched off. In FIG. 15, first to sixth terminals 2 to 7 are fitted on an insulator assembly 1, and first to sixth fixed contacts 2*a* to 7*a* are provided on the terminals 2 to 7 at positions located at the front surface of the insulator assembly 1. In this case, the positions of the fixed contacts 2*a* to 7*a* are set so as to be at an identical circular position.

A contact 8, which is rotated by an operation knob (not shown), is provided on the insulator assembly 1 in contact therewith. This contact 8 has first to third arm portions 9 to 11 having identical lengths and at identical angular pitches, and the arm portions 9 to 11 are adapted to rotate in correspondence with the operation of the operation knob. First to third movable contacts 9*a* to 11*a* are respectively formed on distal ends of the first to third arm portions 9 to 11. These movable contacts 9*a* to 11*a* are adapted to come into contact with the respective fixed contacts 2*a* to 7*a* as the center of rotation of the contact 8 is urged by a compression coil spring (not shown).

FIG. 16 shows the configuration of a circuit which is connected to the first to sixth terminals 2 to 7. In FIG. 16, the first terminal 2 is connected to the cathode of a battery as the body is grounded. The second terminal 3 is connected to an ignition switch through a coil 12*a* of a relay 12. The third terminal 4 is connected to the anode of the battery through a series circuit formed by resistors 13 to 15, a blower motor 16, and a contact 12*b* of the relay 12. The fourth terminal 5 is connected to a common contact point of the resistors 13 and 14, and the fifth terminal 6 is connected to a common contact point of the resistors 14 and 15, and the sixth terminal 7 is directly connected to the blower motor 16.

Accordingly, in the state in which the operation knob is at a position other than the "OFF" position, i.e., when the operation knob has been operated to an air supplying position, the relay 12 is turned on in correspondence with the operation of the ignition switch, and one end of the blower motor 16 is connected to the anode of the battery. At the same time, the other end of the blower motor 16 is connected to the cathode of the battery through the resistors 13 to 15 corresponding to the air supplying position. Consequently, a current corresponding to a resistance value flows across the blower motor 16, and the blower motor 16 rotates in correspondence with the magnitude of the current. Therefore, it is possible to supply air to the interior of the vehicle compartment with four-step intensity corresponding to the air supplying position.

However, although there is a demand for further adding a contact to the blower switch to arrange the intensity of air supply in five steps so as to fine adjust the intensity of air supply, or for using the added contact for another function, the above-described blower switch is capable of coping with only up to four steps with the single contact because of the above-described structure of the contact. For this reason, in a case where five-step switching is required, it is necessary to use two contacts. Hence, there are drawbacks in that the structure becomes complex, and that the external size of the blower switch becomes large in size.

SUMMARY OF THE INVENTION

The invention has been devised in view of the above-described circumstances, and its object is to provide a rotary switch which is capable of increasing the number of contacts without enlarging the external shape while using a single contact.

In accordance with the invention, there is provided a rotary switch comprising: an insulator provided with a plurality of terminals respectively having fixed contacts; a contact having a plurality of arm portions, movable contacts respectively provided on distal ends of the arm portions being respectively adapted to slide on the fixed contacts as the contact rotates; and urging means for imparting contact forces with respect to the fixed contacts to the movable contacts by urging a center of rotation of the contact, particular ones of the fixed contacts being made electrically conductive in correspondence with a rotated position of the contact, wherein a particular one of the arm portions in the contact is set to be short, and angles between respective ones of the arm portions are set such that the contact forces of the movable contacts with respect to the fixed contacts assume magnitudes corresponding to a load connected to the fixed contacts.

In accordance with the above-described arrangement, when the contact rotates, the movable contacts provided on the distal ends of the arm portions of the contact slide on the fixed contacts, so that particular ones of fixed contacts are made electrically conductive through the contact. At this time, since a particular one of the arm portions in the contact is set to be short, the fixed contacts where the movable contacts are brought into contact can be arranged at concentric positions. Hence, it becomes possible to increase the number of contacts without enlarging the external shape. In this case, since angles between respective ones of the arm portions are set such that the contact forces of the movable contacts with respect to the fixed contacts assume magnitudes corresponding to a load connected to the fixed contacts, no drawback occurs to the energization of the contacts although the contact forces of the movable contacts with respect to the fixed contacts are nonuniform due to the varying lengths of the arm portions.

In the above-described arrangement, an arrangement may be provided such that the fixed contact with which the movable contact with a large contact force is brought into contact is connected to a large-current load, while the fixed contact with which the movable contact with a small contact force is brought into contact is connected to an energizing means for energizing the large-current load.

In accordance with the above-described arrangement, since the fixed contact with which the movable contact with a small contact force is brought into contact is connected to an energizing means for energizing the large-current load which is connected to the fixed contact with which the movable contact with a large contact force is brought into contact, the current flowing across the movable contact with a small contact force and the fixed contact is small. Hence, no drawback occurs to the energization of the contacts even if the contact force of the movable contact with respect to the fixed contact is small.

DETAILED DESCRIPTION OF THE PREFERRED EMBODIMENTS

Referring now to FIGS. 1 to 14, a description will be given of an embodiment in which the invention is applied to a blower switch for a vehicle.

Figure 2:
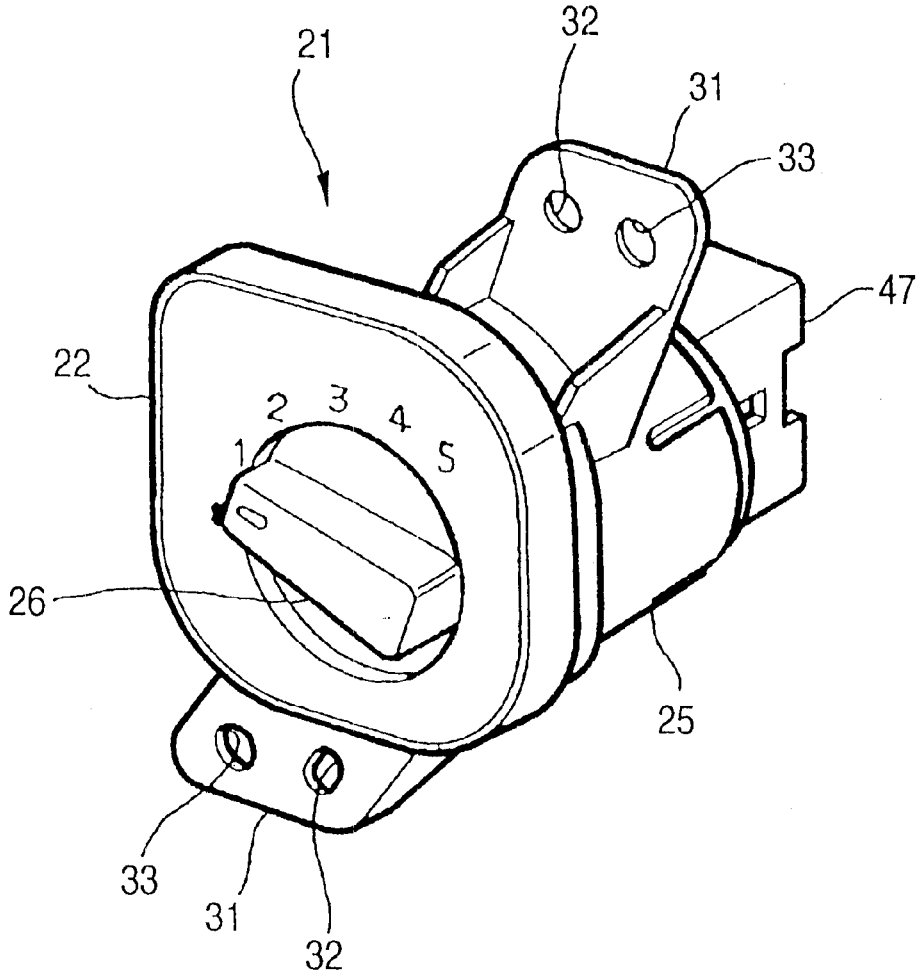
FIG. 2 is a perspective view of a blower switch.
Figure 3:
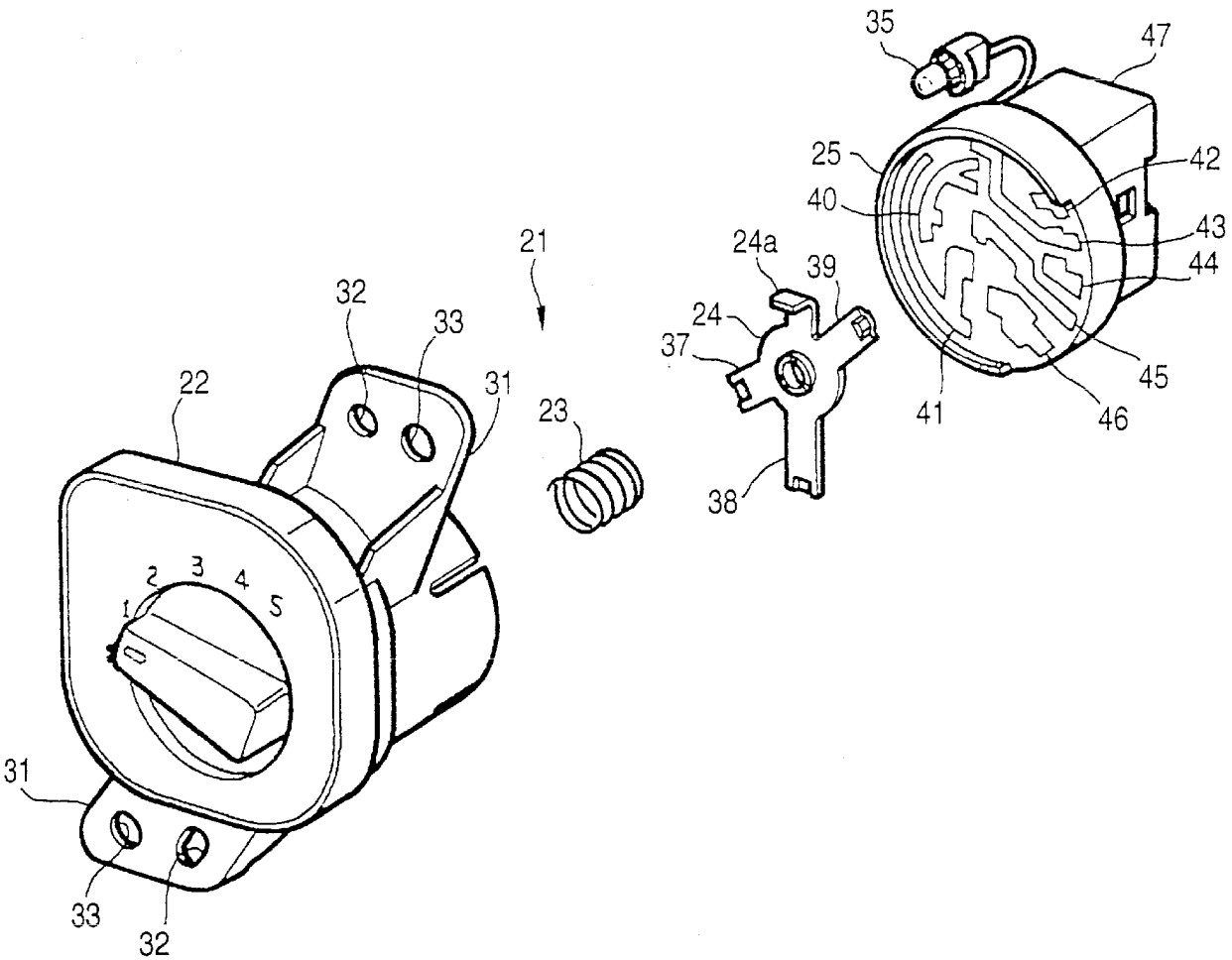
FIG. 3 is an exploded perspective of the blower switch.

FIG. 2 is a perspective view of the blower switch, and FIG. 3 is an exploded perspective view of the blower switch. In FIGS. 2 and 3, a blower switch (corresponding to a rotary switch) 21 includes an operation knob assembly 22, a compression coil spring 23, a contact 24, and an insulator assembly 25.

Figure 4:
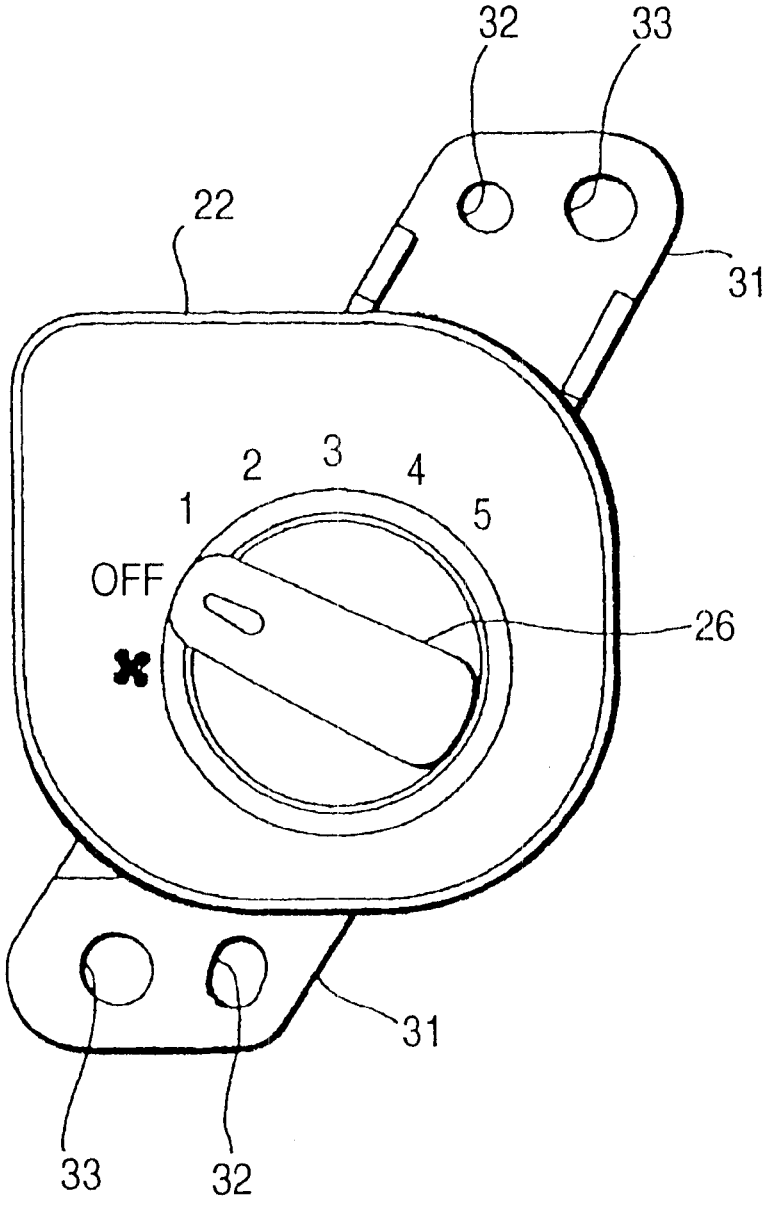
FIG. 4 is a front elevational view of an operation knob assembly.
Figure 5:
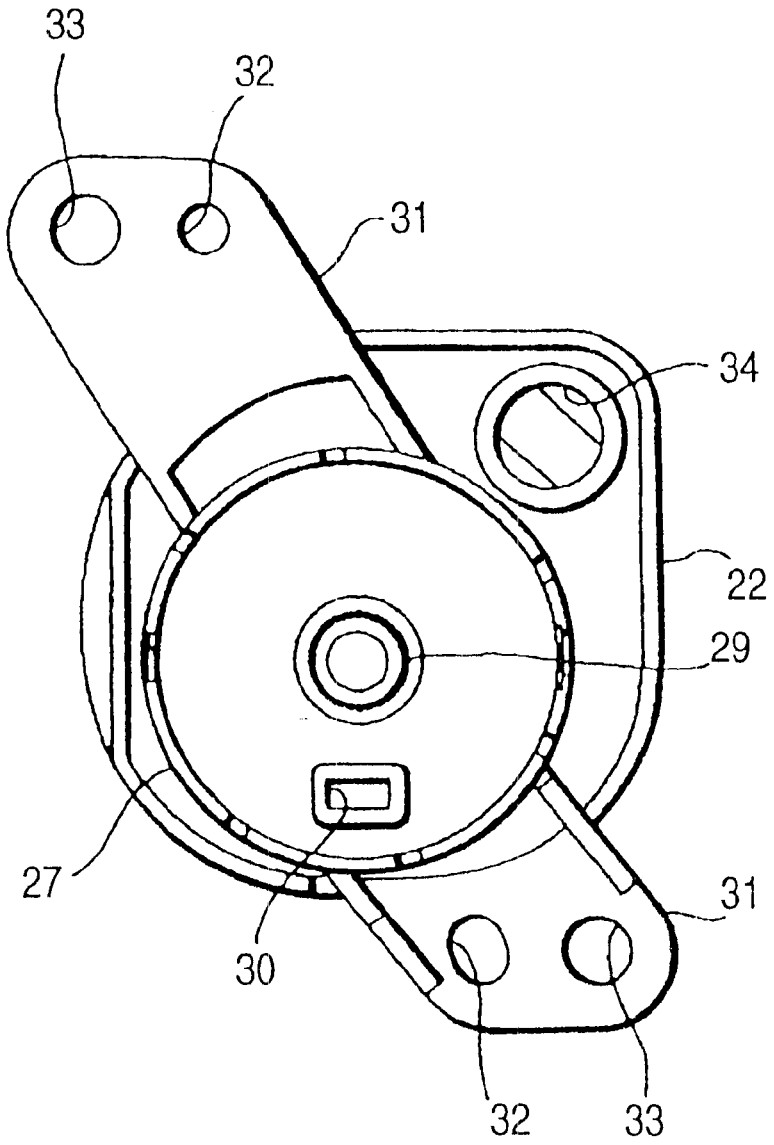
FIG. 5 is a rear view of the operation knob assembly.

FIG. 4 is a front view of the operation knob assembly 22, and FIG. 5 is a rear view thereof. In FIGS. 4 and 5, the operation knob assembly 22 is provided with an operation knob 26. As the operating positions of the operation knob 26, an "OFF" position is set, and an air supplying position "1," an air supplying position "2," an air supplying position "13," an air supplying position "4," and an air supplying position "5" are respectively set at each predetermined angle (22.5°) in correspondence with the intensity of air flow.

This operation knob assembly 22 is for transmitting the rotational operation of the operation knob 26 to the contact 24, and the operation knob 26 is adapted to click at the "OFF" position and each air supplying position at each predetermined angle (22.5°) by an clicking mechanism (not shown). An annular skirt portion 27 is formed on the rear surface of the operation knob assembly 22, and the insulator assembly 25 is adapted to be fitted to the skirt portion 27 (see FIG. 11). A rotor 28 formed integrally with the operation knob 26 is provided within the skirt portion 27, and the rotor 28 is adapted to rotate as the operation knob 26 is rotated. A hollow cylindrical portion 29 (see FIG. 11) is formed projectingly at the center of the rotor 28, and the contact 24 is fitted to the hollow cylindrical portion 29 (see FIG. 11). Further, a recessed portion 30 is formed in the rotor 28.

A pair of attaching portions 31 are integrally provided on the operation knob assembly 22, and a positioning hole 32 and a screw inserting hole 33 are formed in each of the attaching portions 31. In this case, the blower switch 21 can be fixed at a portion subject to attachment by threadedly engaging screws in the screw inserting holes 33 in the state in which projections formed on the portion subject to attachment are inserted in the positioning holes 32.

In addition, a lamp insertion hole 34 is formed in the rear surface of the operation knob assembly 22, and as a lamp 35 (see FIG. 3) inserted in the lamp insertion hole 34 emits light, the figure of a fan and each numeral provided on the front surface of the operation knob assembly 22 are lit up.

Figure 6:
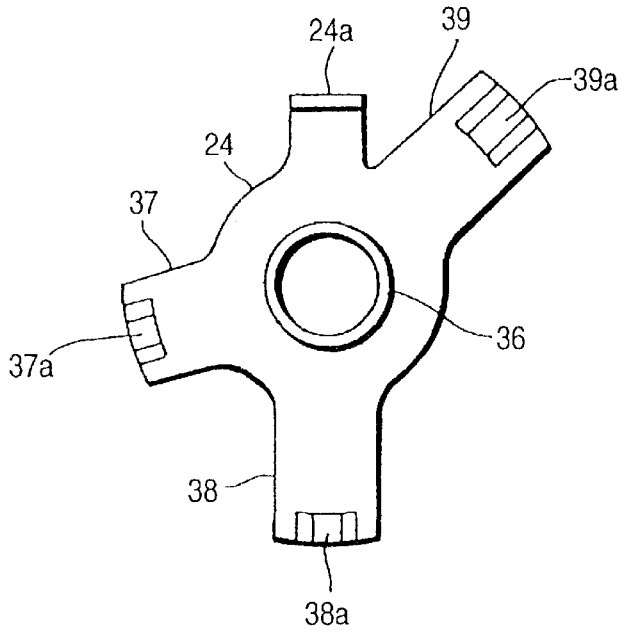
FIG. 6 is a front elevational view of a contact.
Figure 7:
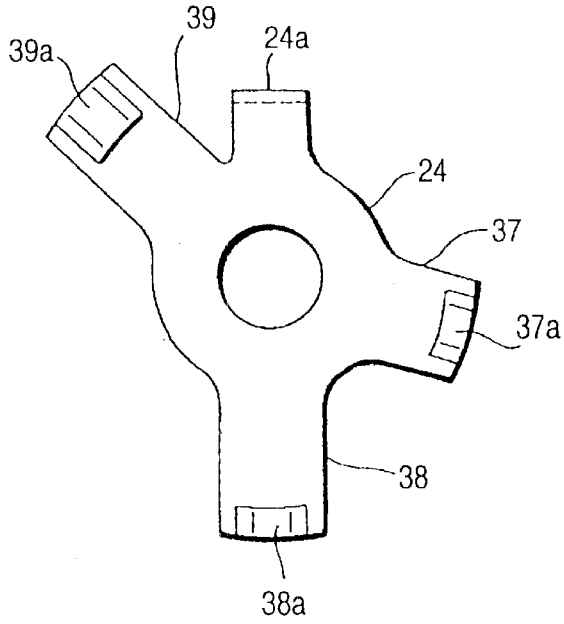
FIG. 7 is a rear view of the contact.

FIG. 6 is a front view of the contact 24, and FIG. 7 is a rear view thereof. In FIGS. 6 and 7, a hollow cylindrical portion 36 is formed projectingly at the center of the contact 24, and the hollow cylindrical portion 36 is fitted over an outer periphery of the hollow cylindrical portion 29 formed on the rotor 28 of the operation knob assembly 22. In this case, the iii 23 is interposed between the insulator assembly 25 and the contact 24 (see FIG. 11). An engaging projection 24*a* is formed on the contact 24, and as the engaging projection 24*a* is retained at the recessed portion 30 formed in the rotor 28, the rotational operation of the operation knob 26 is transmitted to the rotor 28.

The contact 24 is formed with first to third arm portions 37 to 39. First to third movable contacts 37*a* to 39*a* are respectively formed on distal ends of these first to third arm portions 37 to 39, and these movable contacts 37*a* to 39*a* are adapted to slide on the insulator assembly 25.

Here, the length of the first arm portion 37 is set to be shorter than the length of the second and third arm portions 38 and 39, and the angle between the first and second arm portions 37 and 38 is set to be small. By virtue of such an arrangement, in the contact 24, the contact forces of the first and third movable contacts 37*a* and 39*a* are set to be substantially identical, and the contact force of the second movable contact 38*a* is set to be smaller than the contact forces of the first and third movable contacts 37*a* and 39*a*.

Figure 8:
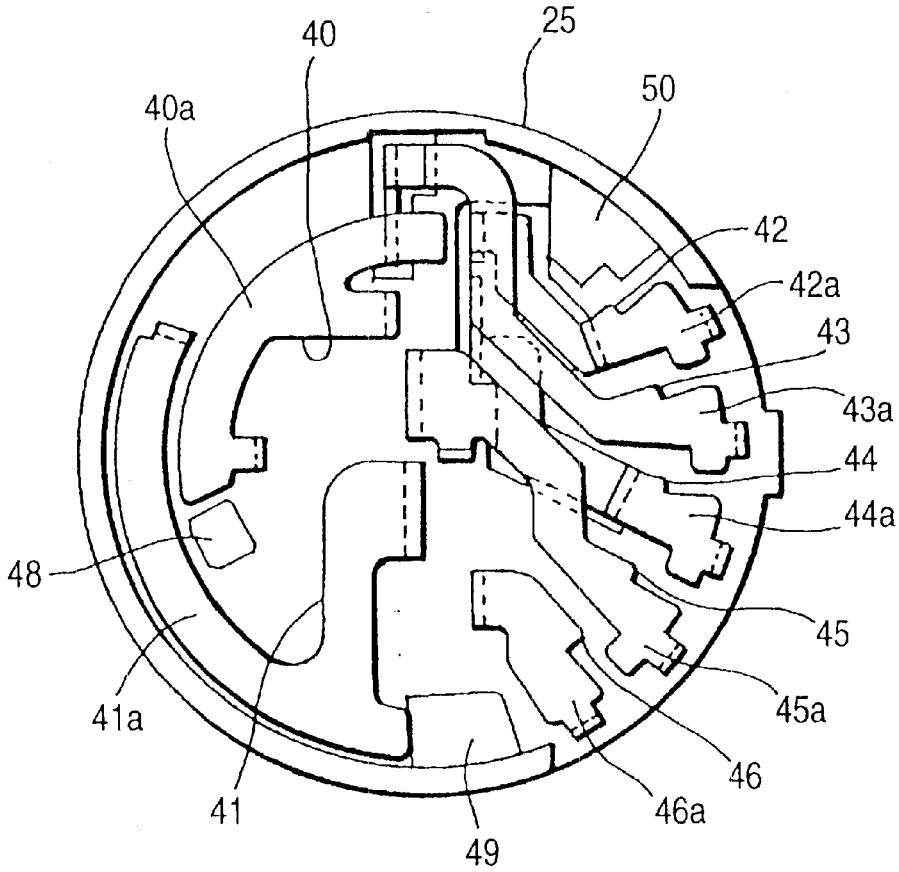
FIG. 8 is a front elevational view of the insulator assembly.
Figure 9:
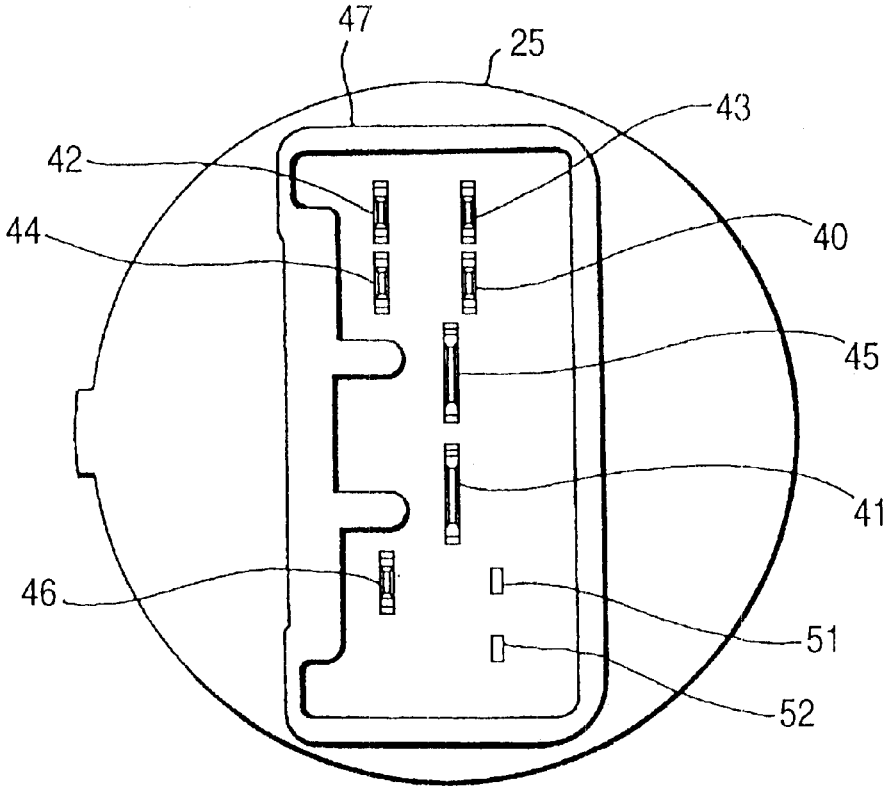
FIG. 9 is a rear view of the insulator assembly.

FIG. 8 is a front view of the insulator assembly 25, and FIG. 9 is a rear view thereof. In FIGS. 8 and 9, first to seventh terminals 40 to 46 are fitted to the insulator assembly 25, and first to seventh fixed contacts 40*a* to 46*a* are respectively provided on these terminals 40 to 46 at positions located at the front surface of the insulator assembly 25. In this case, the first and second fixed contacts 40*a* and 41*a* are formed in semi-annular shapes, and the first fixed contact 40*a* is provided on the inner side of the second fixed contact 41*a*. Namely, the first and second fixed contacts 40*a* and 41*a* are provided at concentric positions such that their portions angularly overlap with each other.

In addition, land portions 48 to 50, which are flush with the first to third terminals 40 to 42, are formed on the insulator assembly 25 in correspondence with these terminals 40 to 42.

A connector 47 is provided on the rear surface of the insulator assembly 25. This connector 47 is provided with terminals 51 and 52 for turning on the lamp 35 in addition to the aforementioned terminals 40 to 46.

Figure 1:
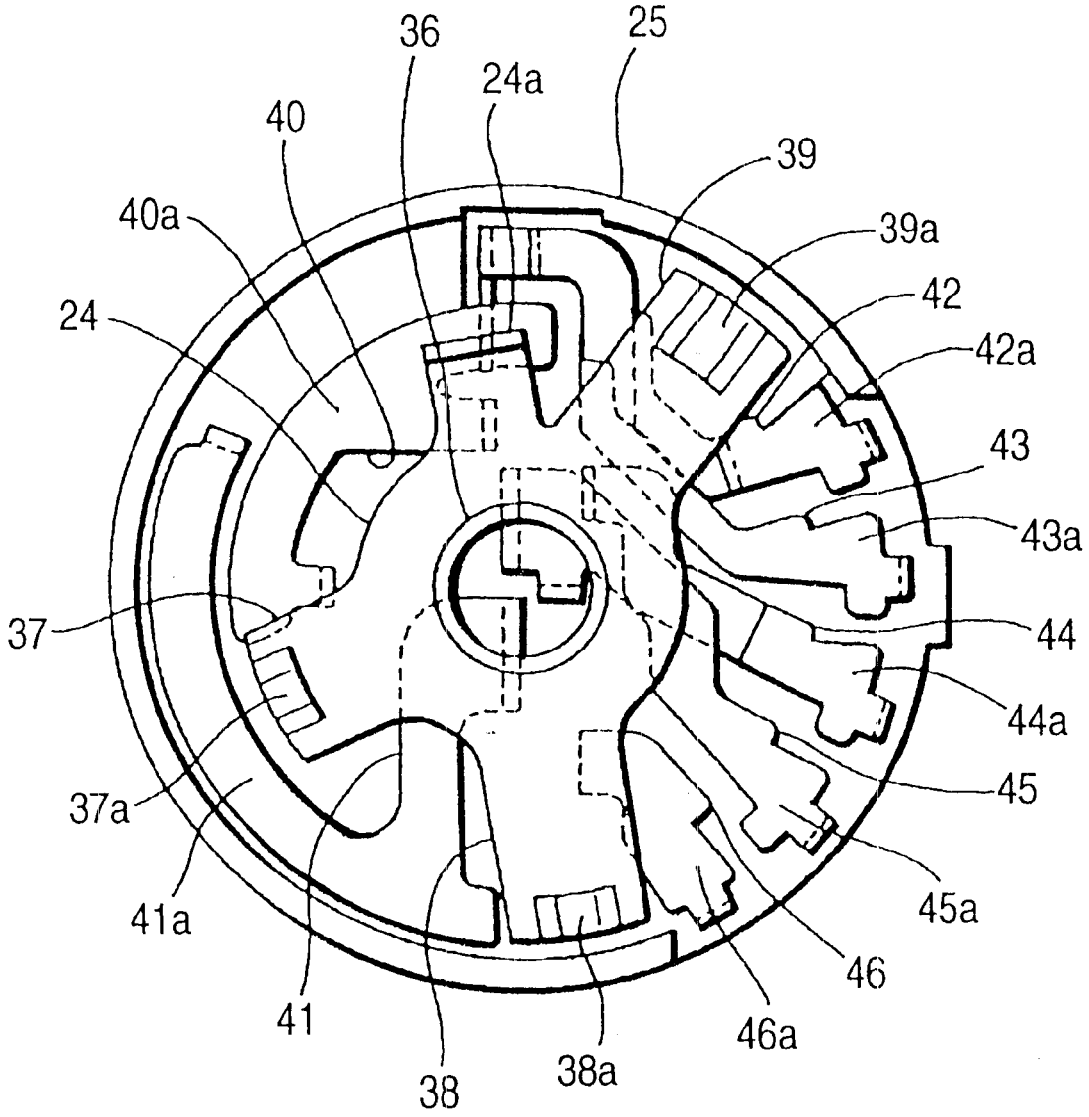
FIG. 1 is a plan view of an insulator assembly shown in a state in which a contact is fitted in accordance with an embodiment of the invention.

FIG. 1 shows the positional relationship between the contact 24 and the insulator assembly 25. In this case, the position of the contact 24 is shown in the state in which the operation knob 26 has been operated to the "OFF" position. In FIG. 1, the first movable contact 37*a* of the contact 24 is located on the first land portion 48 adjacent to the first fixed contact 40*a*, the second movable contact 38*a* is located on the second land portion 49 adjacent to the second fixed contact 41*a*, and the third movable contact 39*a* is located on the third land portion 50 adjacent to the third fixed contact 42*a*.

Figure 10:
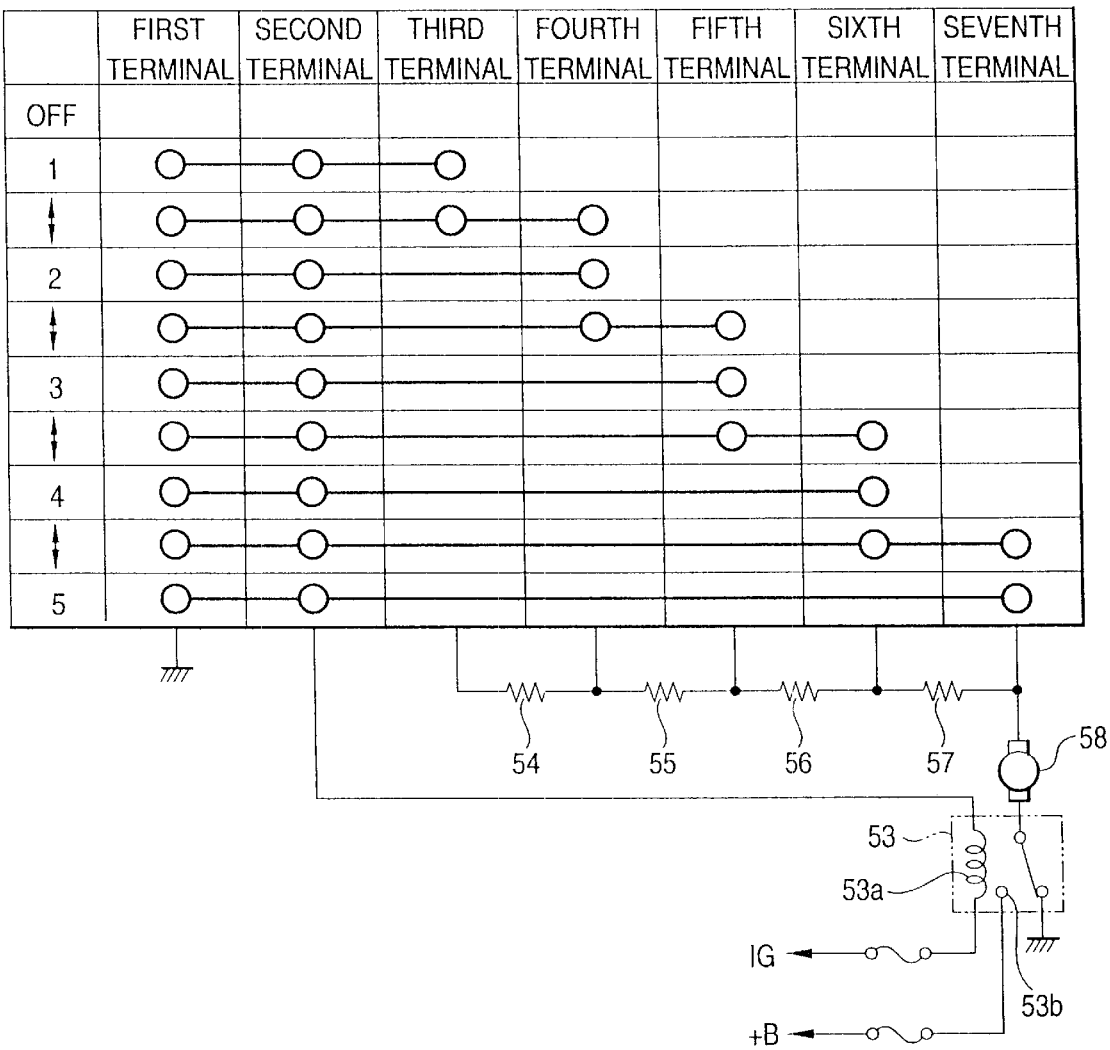
FIG. 10 is a circuit diagram illustrating the relationship of connection in the blower switch.

FIG. 10 shows the configuration of a circuit connected to the first to seventh terminals 40 to 46. In FIG. 10, the first terminal 40 is connected to the cathode of a battery as the body is grounded. The second terminal 41 is connected to an ignition switch through a coil 53*a* of a relay (corresponding to an energizing means) 53. The third terminal 42 is connected to the anode of the battery through a series circuit formed by resistors 54 to 57, a blower motor (max. 200-Watt level) 58, and a contact 53*b* of the relay 53. The fourth terminal 43 is connected to a common contact point of the resistors 54 and 55, the fifth terminal 44 is connected to a common contact point of the resistors 55 and 56, and the sixth terminal 45 is connected to a common contact point of the resistors 56 and 57. The seventh terminal 46 is directly connected to the blower motor 58.

By virtue of the above-described configuration, in the state in which the operation knob 26 of the blower switch 21 is at a position other than the "OFF" position, i.e., when the operation knob 26 has been operated to an air supplying position, the relay 53 is turned on in correspondence with the operation of the ignition switch, and one end of the blower motor 58 is connected to the anode of the battery. At the same time, the other end of the blower motor 58 is connected to the cathode of the battery through the resistors 54 to 57 corresponding to the air supplying position. Consequently, a current corresponding to a resistance value flows across the blower motor 58, and the blower motor 58 rotates in correspondence with the magnitude of the current. Therefore, it is possible to supply air to the interior of the vehicle compartment with five-step intensity corresponding to the air supplying position.

Here, since the distances of the movable contacts of the contact 24 from the center of rotation (the center of urging by the compression coil spring 23) are different, the contact forces with respect to the insulator assembly 25 are different. Hereafter, a description will be given of the contact forces of the movable contacts 37*a* to 39*a*.

Figure 11:
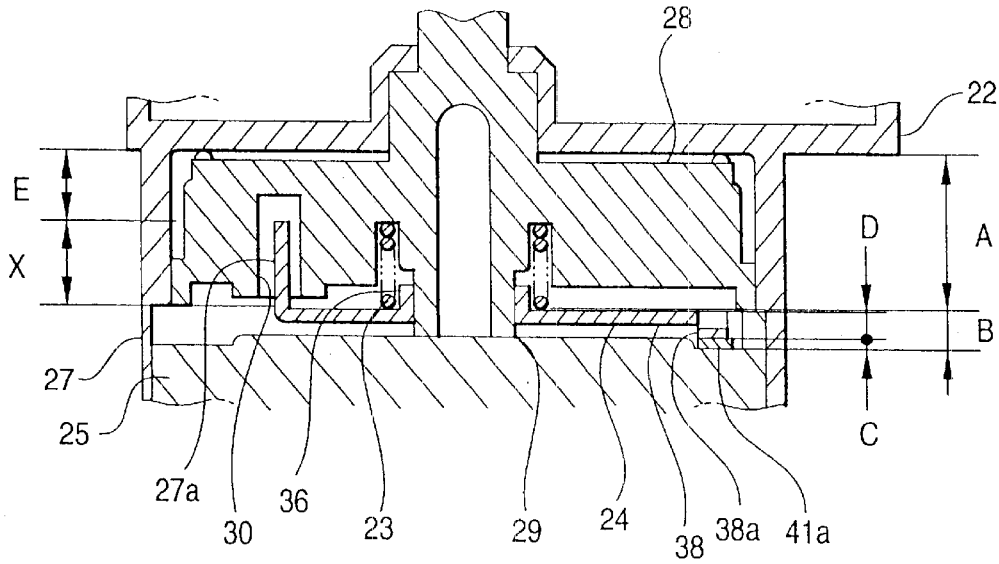
FIG. 11 is a cross-sectional view of essential portions illustrating a state in which a compression coil spring is fitted.

FIG. 11 shows the cross section of principal portions of the operation knob assembly 22. In FIG. 11, the attachment length x of the compression coil spring 23 is a value in which the thicknesswise dimension C of the terminal, the dimension D from the contact position of the contact 24 with respect to the terminal to the contact position thereof with respect to the compression coil spring 23, and the dimension E from the fitting surface of the rotor 28 to the contact surface thereof with respect to the compression coil spring 23 are subtracted from a value obtained by adding together the dimension A from the fitting surface of the rotor 28 to an end surface of the rotor 28 and the dimension B from the end surface of the rotor 28 to the terminal fitting surface of the insulator assembly 25. Namely, the attachment length x of the compression coil spring 23 can be determined as $$\begin{aligned} x &= A + B - C - D - E \\ &= 10.5 + 3 - 0.8 - 1.8 - 4.9 \\ &= 6 \end{aligned}$$

Next, the contact force Fs of the total contacts is a value in which the attaching load w is added to a value in which a value obtained by subtracting the attachment length x from the natural length I of the compression coil spring 23 is multiplied by the spring constant k. Namely, $$\begin{aligned} Fs &= (1 - X) \cdot k + w \\ &= (6 - 6) \cdot 0.5 + 1.25 \\ &= 1.25 \text{ (kgf)} \end{aligned}$$

In other words, since the attachment length x of the compression coil spring 23 is designed so as to be the natural length l, the contact force Fs of the contacts is ideally constituted by the attachment load w alone.

Incidentally, the contact force of a predetermined movable contact can be determined by multiplying by the attachment load w the ratio of the area of a triangle formed by connecting two movable contacts a other than the predetermined movable contact and the center of rotation of the contact 24 to the area of a triangle formed by connecting the three movable contacts 37*a* to 39*a*.

Figure 12:
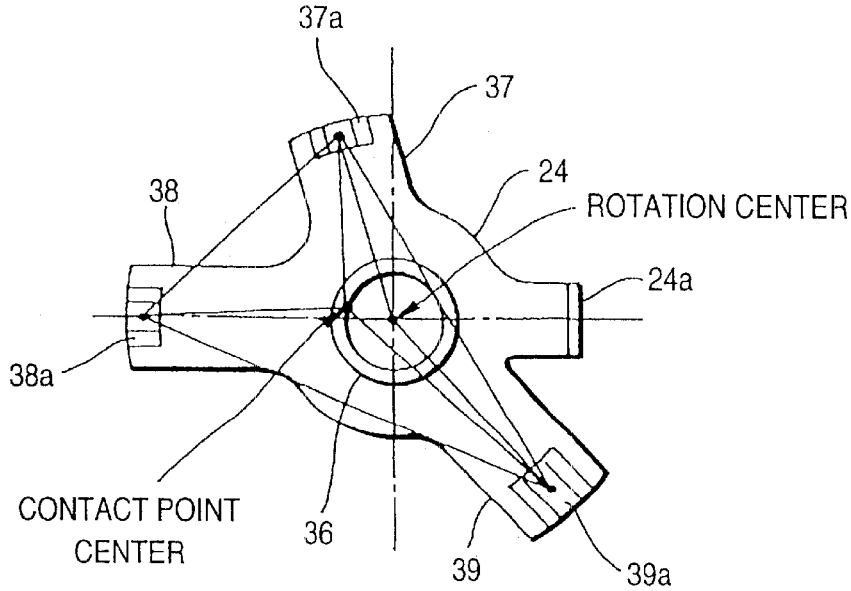
FIG. 12 is a front elevational view of the contact illustrating the positional relationship between the contact center of gravity of the contact and the center of rotation.

It should be noted that since the conventional contact center of gravity agrees with the center of rotation (the urging center), the contact forces of the movable agree with each other. Further, the contact center of gravity in this embodiment (the position where the areas of the three triangles agree with each other) is offset from the center of rotation (the urging center), as shown in FIG. 12. In a case where the contact center of gravity and the urging center agree with each other, although the contact forces of the movable contacts 37*a* to 39*a* agree with each other, the contact forces of the movable contacts 37*a* to 39*a* vary in correspondence with the portion of offset from the contact center of gravity. In this embodiment, it is expected that the contact force of the second movable contact 38*a* located on the side opposite to the direction offset from the contact center of gravity declines, whereas the contact forces of the first and third movable contacts 37*a* and 39*a* located on the same side as the direction offset from the contact center of gravity.

Figure 13:
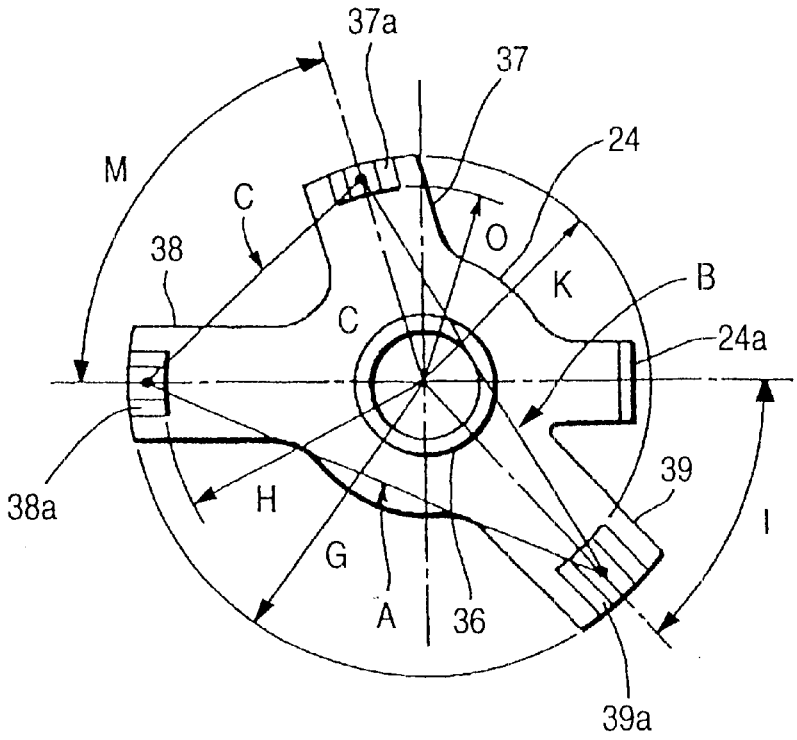
FIG. 13 is a front elevational view illustrating the positional relationship.

Accordingly, the areas of the triangles formed by connecting the center of rotation and the two movable contacts of the movable contacts 37*a* to 39*a* in the contact 24, as shown in FIG. 13, are respectively determined. In this case, since the area of a triangle can be obtained by the length of the base×height/2, the area J of a first triangle (indicated by A in FIG. 13) formed by connecting the center of the second movable contact 38*a*, the center of the third movable contact 39*a*, and the center of rotation of the contact 24 can be determined as $$\begin{aligned} J &= ((G + H)/2) \times ((G + K)/2) \times \sin I \div 2 \\ &= ((18 + 14)/2) \times ((18 + 16)/2) \times \sin 47.5^\circ \\ &= 100.27 \end{aligned}$$

Further, the area N of a second triangle (indicated by B in FIG. 13) formed by connecting the center of the first movable contact 37*a*, the center of the third movable contact 39*a*, and the center of rotation of the contact 24 can be determined as $$N = ((G+H)/2)\times((H-0)/2)\times\sin(M-1)\div 2$$
$$= ((18+14)/2)\times((14+12)/2)\times\sin(75^\circ-47.5^\circ)$$
$$= 48.2$$

Further, the area Q of a third triangle (indicated by C in FIG. 13) formed by connecting the center of the first movable contact 37*a*, the center of the second movable contact 38*a*, and the center of rotation of the contact 24 can be determined as $$Q = ((H+0)/2)\times((G+K)/2)\times\sin M\div 2$$
$$= ((14+12)/2)\times((18+16)/2)\times\sin 75^\circ\div 2$$
$$= 106.74$$

Hereafter, the contact forces of the respective movable contacts 37*a* to 39*a* are determined.

$$R = Fs\times(J/(J+N+Q))$$
$$= 1.25\times 100.27/(100.27+48.02+106.74)$$
$$= 0.49(\text{kgf})$$
$$= 4.82(\text{N})$$

Further, the contact force S of the second movable 38*a* can be determined as $$S = Fs\times(N/(J+N+Q))$$
$$= 1.25\times 48/(100.27+48.02+106.74)$$
$$= 0.24(\text{kgf})$$
$$= 2.31(\text{N})$$

Further, the contact force T of the third movable 39*a* can be determined as $$T = Fs\times(Q/(J+N+Q))$$
$$= 1.25\times 106.74/(100.27+48.02+106.74)$$
$$= 0.52(\text{kgf})$$
$$= 5.13(\text{N})$$

Accordingly, the ratio among the contact force of the first movable contact 37*a*, the contact force of the second movable contact 38*a*, and the contact force of the third movable contact 39*a* becomes 1:2.1:2.2. Namely, in the contact 24, although the second arm portion 38 and the third arm portion 39 have substantially identical lengths, the contact force of the second movable contact 38*a* provided on the second arm portion 38 is one-half of the contact force of the third movable contact 39*a* provided on the third arm portion 39. Further, although the first arm portion 37 is shorter than the third arm portion 39, the contact force of the first movable contact 37*a* provided on the first arm portion 37 and the contact force of the second movable contact 38*a* provided on the second arm portion 38 are substantially identical.

Next, a description will be given of the operation of the above-described arrangement.

Figure 14:
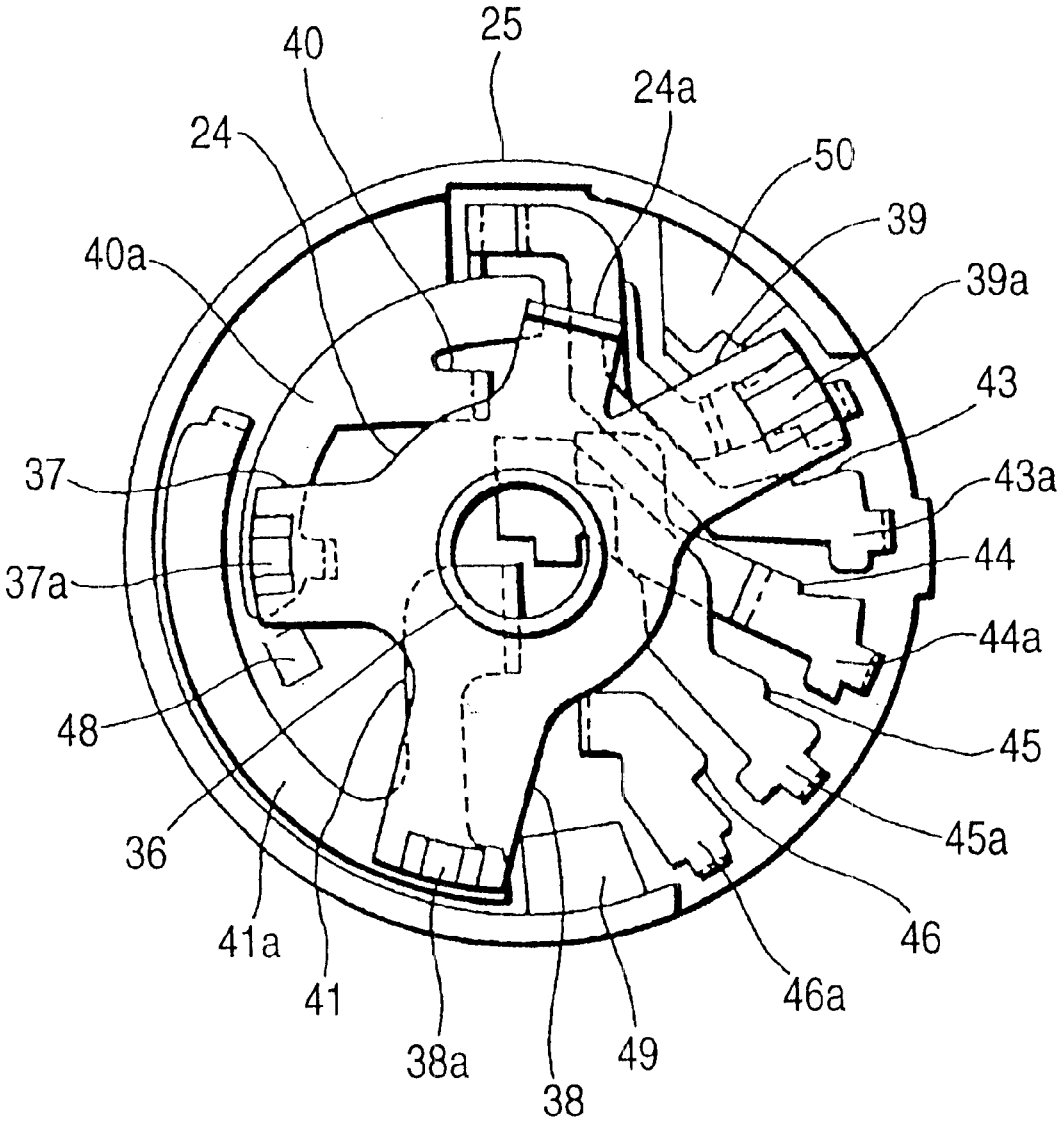
FIG. 14 is a front elevational view of the insulator assembly illustrating a state in which the contact has been rotated by one step.
Figure 15:
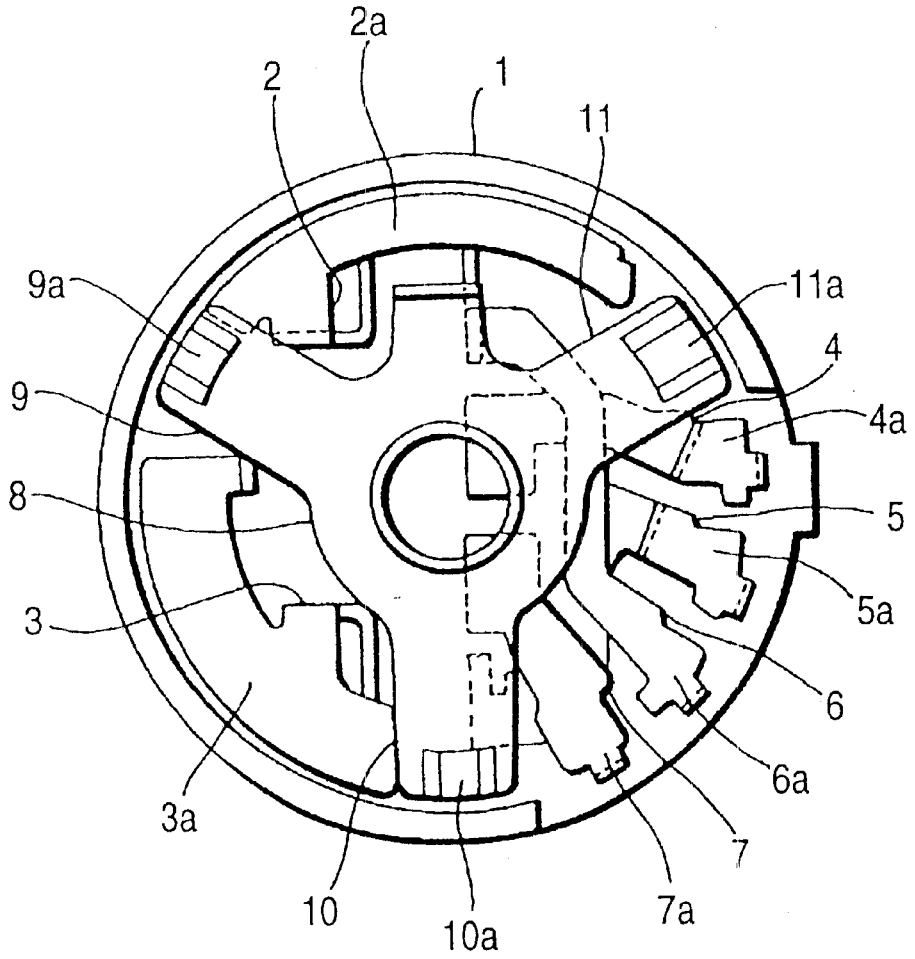
FIG. 15 is a diagram illustrating a conventional example and corresponding to FIG. 1.
Figure 16:
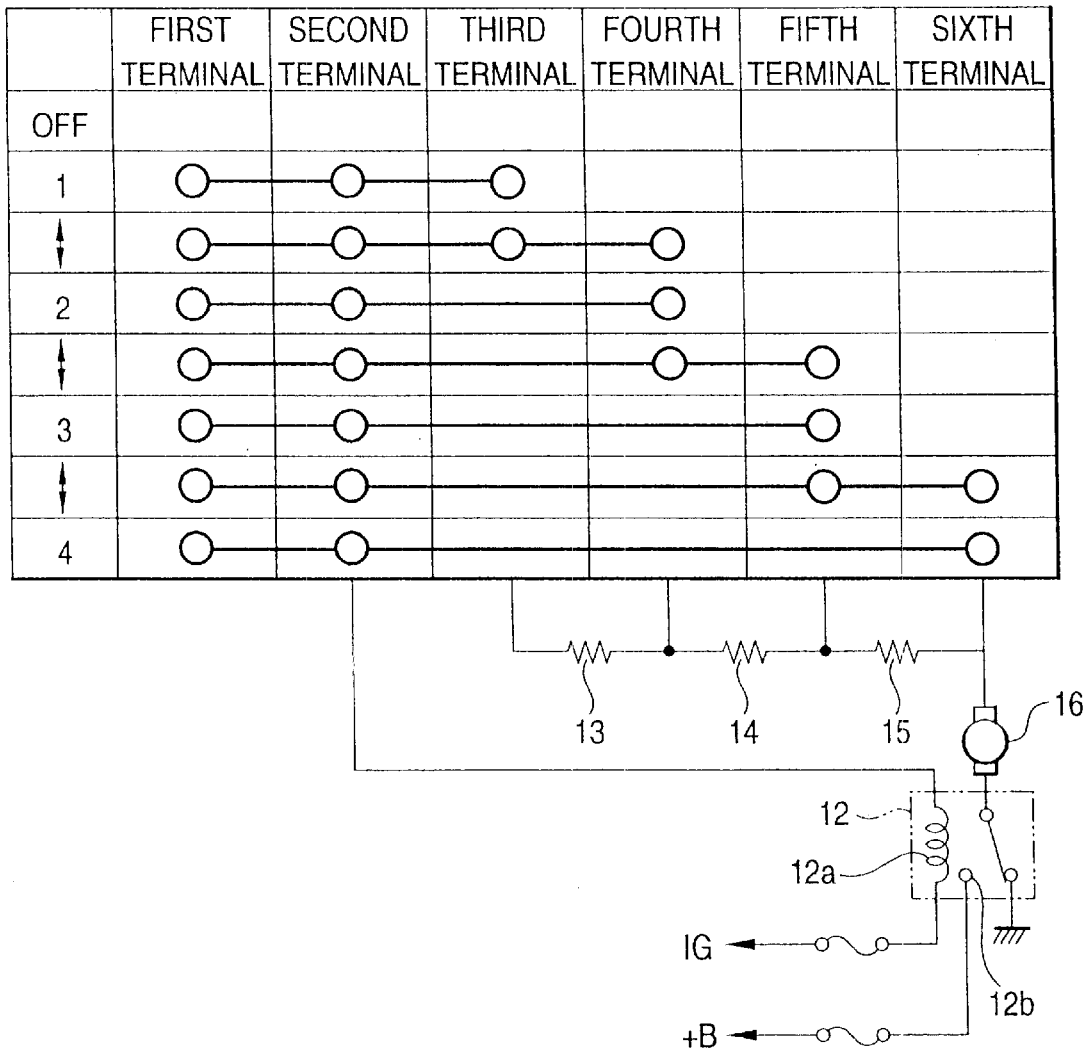
FIG. 16 is a diagram corresponding to FIG. 10.

If the operation knob 26 of the blower switch 21 is operated from the "OFF" position to the air supplying position "1", the contact 24 rotates to the position shown in FIG. 14 in conjunction with the rotation of the operation knob 26. Namely, the first movable contact 37*a* leaves the first land portion 48 and moves onto the first fixed contact 40*a*, the second movable contact 38*a* leaves the second land portion 49 and moves onto the second fixed contact 41*a*, and the third movable contact 39*a* leaves the third land portion 50 and moves onto the third fixed contact 42*a*. Consequently, as shown in FIG. 10, the first terminal 40 and the second terminal 41, the third terminal 42 are made electrically conductive through the contact 24.

Here, if the ignition switch is turned on, the coil 53*a* of the relay 53 is energized, so that the contact 53*b* of the relay 53 is turned on. As a result, since the current flows across the blower motor 58 through the resistors 54 to 57, air is supplied to the interior of the vehicle compartment in correspondence with the rotation of the blower motor 58. In this case, since the current flowing across the blower motor 58 is smallest, the number of revolution of the blower motor 58 is small, and the intensity of air supply to the interior of the vehicle compartment is smallest.

Next, if the operation knob 26 is operated to the air supplying position "2" to increase the rate of air supply to the interior of the vehicle compartment, the contact 24 rotates further, and the third movable contact 39*a* is located at the second fixed contact 41*a*. At this time, since the state of energization between the first terminal 40 and the second terminal 41 is maintained, the on state of the contact 53*b* of the relay 53 is maintained, so that the blower motor 58 is energized through the resistors 55 to 57. As a result, the energizing current flowing across the blower motor 58 increases, so that the number of revolution of the blower motor 58 increases, and the rate of air supply to the interior of the vehicle compartment increases correspondingly.

Similarly, by operating the operation knob to the air supplying position "3," to the air supplying position "4," and to the air supplying position "5," it is possible to increase the rate of air supply to the interior of the vehicle compartment in steps.

Incidentally, since the blower switch 21 is connected so as to directly switch off a large energizing current flowing across the blower motor 58, it is necessary to set a large contact force for the movable contact where the energizing current to the blower motor 58 flows. Nevertheless, if attention is focused on the second movable contact 38*a*, which is connected to the coil 53*a* of the relay 53 through the second fixed contact 41*a*, its energizing current is smaller than the energizing current to the blower motor 58. Therefore, no hindrance is caused even if the contact force of the second movable contact 38*a* is set to be smaller than the contact forces of the first and third movable contacts 37*a* and 39*a*.

In accordance with the above-described embodiment, since the length of the second arm portion 38 in the contact 24 is formed to be shorter than the other arm portions 37 and 39, the first and second fixed contacts 40*a* and 41*a* where the first and second movable contacts 37*a* and 38*a* are brought into contact can be provided at concentric positions. Accordingly, unlike the conventional example in which the first to third arm portions in the contact are formed with identical lengths, the intensity of air supply can be arranged with five-step switching by adding a fixed contact without enlarging the blower switch 21.

In this case, the angles between respective ones of the arm portions 37 to 39 in the contact 24 are set such that the contact forces of the movable contacts 37*a* to 39*a* with respect to the fixed contacts 40*a* to 46*a* assume magnitudes corresponding to the relay 53 connected to the relevant fixed contacts 40*a* to 46*a* or the blower motor 58. Therefore, no hindrance is caused to the energization for each load even if the contact forces of the movable contacts 37*a* to 39*a* differ by setting the length of the first arm portion 37 among the arm portions 37 to 39 of the contact 24 to be short, as described above.

The invention should not be limited to the above-described embodiment, and can be modified or expanded as shown below.

The intensity of air supply is not limited to five steps, and maybe arranged in six steps or more.

The blower motor 58 may be energized through a power transistor instead of the relay 53.

A blower motor for an air conditioner for a rear seat may be connected to the fixed contact added in the blower switch 21, and the blower motor for an air conditioner for a rear seat may be controlled by the operation of the blower switch 21.

The circuit which is connected to the fixed contacts where the movable contacts with small contact forces are brought into contact is not limited to the coil of the relay, and in a case where a plurality of motors are directly switched off by the rotary switch, motors with small energizing currents may be directly switched off.

The invention is applicable not only to the blower switch but also to various other switches.

As is apparent from the foregoing description, in accordance with the rotary switch of the invention, a particular one of the arm portions in the contact is set to be short, and angles between respective ones of the arm portions are set such that the contact forces of the movable contacts with respect to the fixed contacts assume magnitudes corresponding to a load connected to the fixed contacts. Accordingly, an outstanding advantage can be offered in that the fixed contacts can be provided at concentric positions, and the number of contacts can be increased without enlarging the external shape while using a single contact.

What is claimed is:

1. A rotary switch comprising:

an insulator provided with a plurality of terminals respectively having first contacts that are fixed contacts;

a second contact having a plurality of arm portions, said arm portions having movable contacts respectively on distal ends thereof, said movable contacts slide on said fixed contacts, respectively in response to rotation of said second contact; and means for imparting contact forces with respect to said fixed contacts to said movable contacts by urging a center of rotation of said second contact, said fixed contacts to be selected made electrically conductive in correspondence with a rotated position of said second contact, wherein at least one said arm portion in said second contact is short as compared with the other, and angles defined between respective ones of said arm portions are set such that the contact forces of said movable contacts with respect to said fixed contacts correspond in magnitudes to a load connected to said fixed contacts.

2. The rotary switch according to claim 1, wherein said fixed contact is brought into contact with said movable contact with a large contact force and is connected to a large-current load, and further comprising:

energizing means for energizing the large-current load, said fixed contact is brought into contact with said movable contact with a small contact force and is connected to the energizing means.

3. The rotary switch according to claim 2, wherein said energizing means is a relay.

4. A rotary switch comprising:

an insulator with a plurality of terminals, each terminal including a fixed contact; and a rotatable contact having a center of rotation and a plurality of arm portions, each arm portion including a movable contact that slides on a fixed contact in response to a rotation of the rotatable contact;

wherein one of said arm portions is shorter than the other arm portions when measured from the center of rotation to the movable contact of said shorter arm portion.

5. The rotary switch according to claim 4, wherein when said movable contact slides over said fixed contact said fixed contact conducts electricity.

6. The rotary switch according to claim 5, wherein said fixed contacts conduct electricity in response to a rotation of the said rotatable contact.

7. The rotary switch according to claim 6, wherein said arm portions include a proximal end and a distal end and said movable contacts are provided on the distal ends of said arm portions.

8. The rotary switch according to claim 6, wherein the movable contacts are connected to energizing means.

9. The rotary switch according to claim 6, comprising first, second and third arm portions where the angle between the first and second arm portions is smaller than the angle between the second and third arm portion and said shorter arm portion is the first arm portion.

10. The rotary switch according to claim 6, wherein the rotatable contact includes a center of gravity that is offset from the center of rotation.

11. The rotary switch according to claim 9, comprising first, second and third contact forces corresponding to the first, second and third arm portions respectively and the contact forces correspond to a current load that flows through said fixed contacts when said movable contacts slide on said fixed contacts.

12. The rotary switch according to claim 11, wherein the first contact force is substantially identical to the third contact force.

13. The rotary switch according to claim 11, wherein the ratio of contact forces between the second, first, and third contact forces is 1:2.1:2.2.

14. The rotary switch according to claim 10, wherein said movable contacts have a contact force and the contact force of each movable contact varies in correspondence with the offset dimension between the center of gravity and the center of rotation.

15. A rotary switch comprising:

an insulator including a plurality of terminals, wherein said terminals each includes fixed contacts;

a second contact including a plurality of arm portions, wherein said arm portions each has a distal end with a movable contact;

said movable contacts slide over said fixed contacts in response to a rotation of said second contact; and one of said arm portions in said second contact is shorter than the other arm portions.

* * * * *